United States Patent [19]

Thüs

[11] Patent Number: 4,951,885

[45] Date of Patent: Aug. 28, 1990

[54] CRUSHER UNIT FOR USE IN A MOBILE CRUSHING SYSTEM

[75] Inventor: Heinrich Thüs, Duisburg, Fed. Rep. of Germany

[73] Assignee: Fried. Krupp Gesellschaft mit beschränkter Haftung, Essen, Fed. Rep. of Germany

[21] Appl. No.: 264,010

[22] Filed: Oct. 27, 1988

[30] Foreign Application Priority Data

Oct. 31, 1987 [DE] Fed. Rep. of Germany ..... 3736966

[51] Int. Cl.[5] ..... B02C 21/02

[52] U.S. Cl. ..... 241/101.7; 241/285 R

[58] Field of Search ..... 241/207-216, 241/101.7, 285 R, 285 A, 285 B

[56] References Cited

U.S. PATENT DOCUMENTS

| | | | |
|---|---|---|---|
| 3,983,950 | 10/1976 | Fabian | 241/101.7 X |
| 4,598,875 | 7/1986 | Bronson et al. | 241/101.7 X |
| 4,763,845 | 8/1988 | Guggenheimer et al. | 241/101.7 |

OTHER PUBLICATIONS

H. Hurtmanns et al., "Kunstruktiver Aufbau und Arbeitsweise eines Feinkreiselbrechers" [Designs and Mode of Operation of a Fine Gyratory Crusher], Aufbereitungs-Technik, No. 4 (1967), 8 pages.

Von H. Fabian, "Rohstoffaufbereitung mit mobilen und halbmobilen Brechanlagen" [Raw Material Beneficiation by Mobile and Semi-Mobile Crushing Plants], Zement-Kalk-Gips, No. 11 (1978) pp. 565-568.

Virgil W. Smith Jr., et al., "User-Made Crusher Raises Output," Rock Products, (Aug., 1986), pp. 28-32.

*Primary Examiner*—Mark Rosenbaum

*Attorney, Agent, or Firm*—Spencer & Frank

[57] ABSTRACT

A crusher unit is part of a mobile crushing system which may also include one or more endless conveyors, if required. The crusher unit has a substructure (1) that can be set down on the ground (14), a crusher (4), and a housing (9) for the control and supply devices that are needed. Transmission of vibrations from the crusher (4) to the housing (9) is avoided by disposing the housing (9) on a frame (8) which, in operation, is deposited on the ground (14). However, if the substructure (1) is lifted, as when the crusher unit is transported from one location to another, the frame is supported on the substructure.

20 Claims, 3 Drawing Sheets

CRUSHER UNIT FOR USE IN A MOBILE CRUSHING SYSTEM

BACKGROUND OF THE INVENTION

The invention relates to a crusher unit for use in a mobile crushing system of the type which includes a substructure that can be set down on &.he ground, a crusher, and a housing for the necessary control and supply devices and, if required, at least one endless conveyor.

The increasing size of such mobile crushing systems has mandated that they be separated into several individual units in order to retain or improve the mobility of the system. The unit carrying the crusher, which forms the central point of the system, is generally also the largest and heaviest of these units. In such a unit, in which the crushers have a considerable height, it has become known to accommodate the required control and supply devices for the crusher in a separate, tower-like housing disposed on the substructure of the crusher unit. The upper region of the housing accommodates, in particular, the electrical and control devices for controlling the crushing system. The drawback of such an arrangement is that vibrations occurring during operation of the crusher are transferred over the substructure to the housing, and are most noticeable in the upper region of the housing where they are least desired. Such vibrations may not only cause malfunctions in the control services but may also considerably annoy the operating crew employed there.

SUMMARY OF THE INVENTION

It is therefore an object of the present invention to provide a crusher unit of the above mentioned type which is configured so that vibrations in the housing are avoided. This object is accomplished by providing a crusher unit in which the housing for the control and supply devices is disposed on a frame which, in operation, is set down on the ground. However, when the substructure carrying the crusher is lifted, the housing is supported by the substructure.

In a simple manner and without significant additional expenditures, the present invention prevents the transfer of vibrations from the crusher to the housing since the frame supporting the housing has no connection with the substructure during operation.

The present invention can be employed for various shapes and types of substructures; in each case only simple adaptation measures are required. The substructure may here have a portal shape so that it can be moved by means of a transporting vehicle that is equipped with lifting devices and drives underneath it, or the substructure itself may be equipped with moving or stepping mechanisms.

During transport of the crusher unit it is advisable to secure the housing against sliding or tilting.

DESCRIPTION OF A PREFERRED EMBODIMENT

Figure 1:
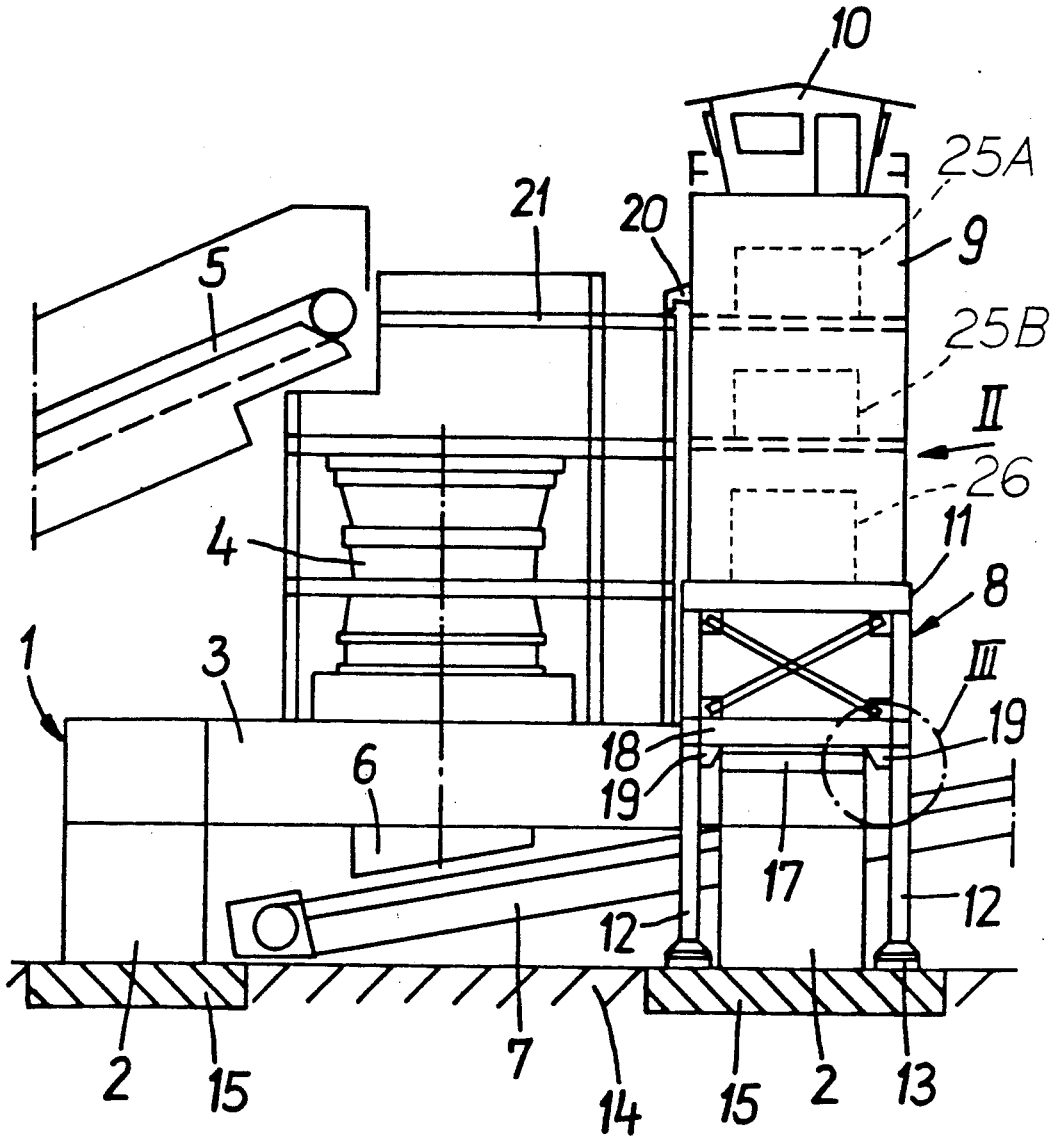
FIG. 1 is a front view of a crusher unit in accordance with the present invention.

As can be seen in FIG. 1, the illustrated crusher unit is part of a mobile crushing system. The crusher unit includes a substructure 1 forming a platform 3 which, when seen from the top, has a rectangular shape. Substructure 1 is provided with a supporting foot 2 at each corner. Platform 3 supports a crusher 4 configured as a gyratory crusher. Crusher 4 receives the material to be crushed over a conveyor belt 5, such as a plate conveyor, which is part of a further unit (not entirely shown) of the mobile crushing system. A conveyor belt 7 is part of an additional unit (not entirely shown) of the mobile crushing system. During operation of the system, one end of conveyor belt 7 is disposed below platform 3 of substructure 1 as illustrated and receives the crushed material via chute 6. The supporting feet 2 of substructure 1 form portal-like openings through which a transporting vehicle (not shown) equipped with a lifting device, preferably a tracked transporting vehicle, can drive underneath platform 3. The substructures of the units (not shown) supporting conveyor belts 5 and 7 have the same configuration. To lift and transport the crusher unit and the other units, the transporting vehicle lifts the respective unit approximately underneath its center of gravity. To accomplish this, chute 6 is first removed from substructure 1.

In the region of the end of substructure 1 facing away from conveyor belt 5, a box-shaped and tower-like housing 9 is provided on a frame 8. This housing accommodates the supply devices 25A and 25B for supplying power to operate the crusher unit 4 and the control devices 26 for the entire crushing system. A control cabin 10 is disposed on top of housing 9. From cabin 10, the entire crushing system is clearly visible during operation.

Frame 8 includes a platform 11 which supports the housing 9. On its underside, the platform 11 is provided with four downwardly oriented supports 12 arranged in a rectangle. In the operating state, the frame 8 is set down on the ground 14 by means of feet 13 disposed underneath supports 12. If the ground is too soft, special foundations 15 are provided which support feet 2 and feet 13.

Figure 3:
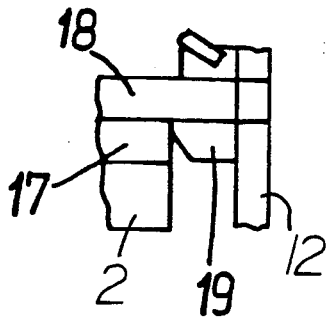
FIG. 3 is a detail view III of FIG. 1 to a larger scale.
Figure 2:
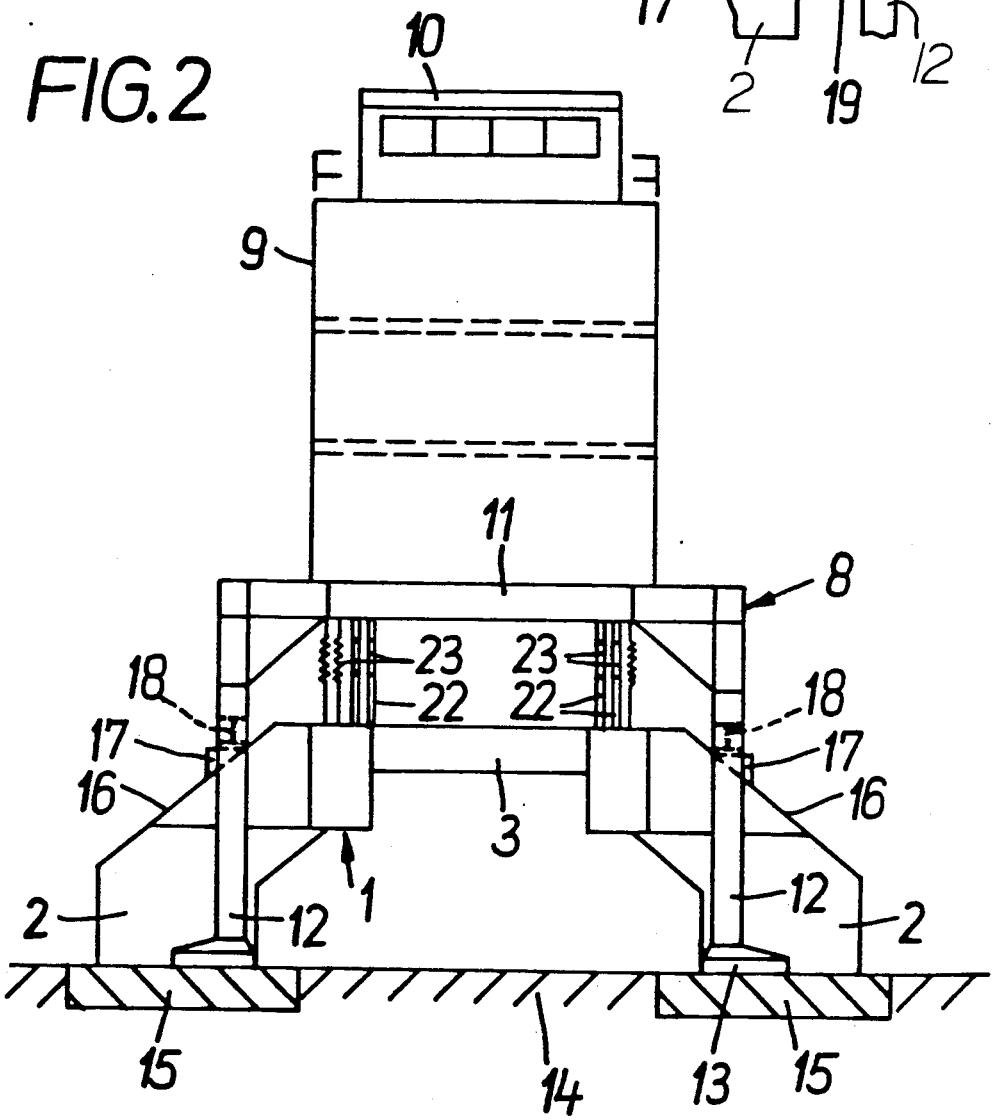
FIG. 2 is a front view of the crusher unit seen in the direction of arrow II of FIG. 1.

As shown in FIG. 2, two supporting feet 2 are arranged in pairs at each end of platform 3, and are configured so that the feet 2 have downwardly sloping surfaces 16. The two supporting feet 2 at each end face one another in a mirror image. At the end of platform 3 lying beneath housing 9, and in the region of frame 8, each supporting foot 2 is provided with a projection 17 on its sloping surface 16. The projections 17 have flat tops. In the region of these projections 17, which are also symmetrically arranged in a mirror image, two supports 12 pass around the sides of each one of the two associated supporting feet 2. As a whole, frame 8 forms a portal which surrounds platform 3 of substructure 1. Above each projection 17, the supports 12 passing around the respective supporting foot 2 are connected with one another by means of a carrier 18 whose underside faces the top of the respectively associated projection 17. When substructure 1 is lifted, the carrier 18 is supported on the projection 17 as shown in FIG. 3. However, when the crusher unit is operating the feet 2 and the feet 13 are supported on the ground, in which case the projections 17 are beneath and spaced apart from the carriers 18.

FIG. 3 also shows that stops 19 are provided in the corners between carriers 18 and supports 12 at the underside of the respective carrier. If substructure 1 is lifted, i.e. if the crusher unit is transported, these stops 19 lie against the ends of projections 17 on the sides of supporting feet 2. Stops 19 have portions which slope downwardly and toward supports 12 in such a manner that they form a latching seat which, during transport, secures frame 8 against displacement in the longitudinal direction of the projection (which is also the longitudinal direction of the substructure). Substructure 1 is secured in the transverse direction in that the lower, inner edges of carriers 18 latch in the oppositely disposed corners formed by the upper faces of projections 17 and the exterior faces of supporting feet 2. For this purpose, a sufficiently large vertical abutment face (not visible in the drawing) may be provided.

Figure 4:
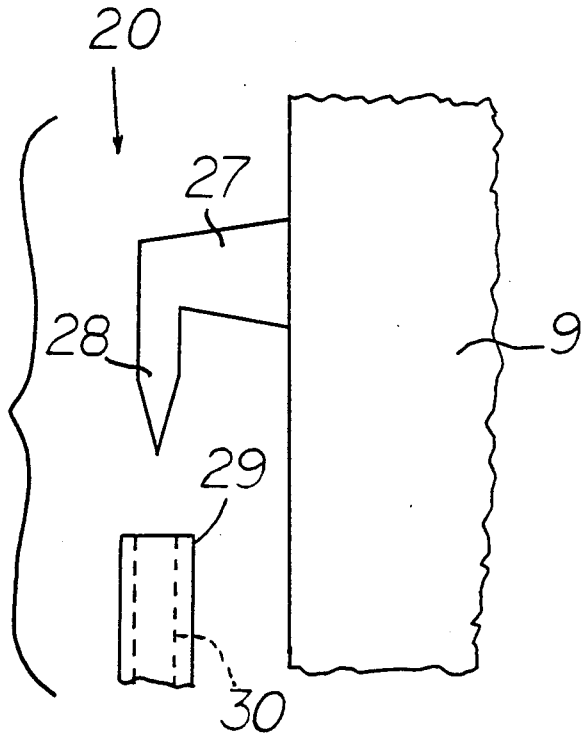
FIG. 4 is a side view illustrating a latch coupling for steadying the crusher unit when it is moved.

Housing 9 is secured against tilting during transport by the provision of two latch couplings 20 (see FIG. 1) in the upper region of housing 9 and of crusher 4. These couplings 20 are released during operation of the system. The simplest form of such a latch coupling 20 is shown in FIG. 4, and includes a first member 27 which is attached to housing 9 and which includes a pin 28. Pin 28 is conically tapered toward its lower end. A second member 29 is immovably mounted with respect to substructure 1 and crusher 4 (and may be a pipe forming part of a frame-like housing 21 which surrounds crusher 4). Member 29 has a bore 30 into which pin 28 extends when substructure 1 is raised prior to moving the crusher unit to a different location. Similar latch couplings may also be employed additionally or instead of the latchable seats formed by stops 19 and projections 17.

The control and supply devices, such as electrical, hydraulic, and pneumatic assemblies, accommodated in housing 9 are connected with the associated machines and assemblies by way of conduits 22 which pass through substructure 1. To avoid the transfer of vibrations through conduits 22, these conduits, which are preferably brought out through the underside of the housing 9, are equipped with flexible connections 23 such as hoses, cables or the like.

The present disclosure relates to the subject matter disclosed in Federal Republic of Germany application No. P 37 36 966.0 of Oct. 31st, 1987, the entire disclosure of which is incorporated herein by reference.

It will be understood that the above description of the present invention is susceptible to various modifications, changes and adaptations, and the same are intended to be comprehended within the meaning and range of equivalents of the appended claims.

What is claimed is:

1. A crusher unit for use in a mobile crushing system, said crusher unit comprising:

a substructure, the substructure including first support means for supporting the substructure on the ground;

a crusher mounted on the substructure;

a housing;

a frame on which the housing is disposed, the frame including second support means for supporting the frame on the ground when the crusher unit is in operation, the frame and housing being disconnected from the substructure and crusher when the crusher unit is in operation to isolate the frame and housing from vibration of the crusher; and third support means for supporting the frame on the substructure if the substructure is lifted.

2. The crusher unit of claim 1, wherein the frame is configured as a portal which surrounds a portion of the substructure.

3. The crusher unit of claim 2, wherein the portal has sides, wherein the frame comprises a platform, and wherein the second support means of the frame comprises at least three supports, two of the supports being positioned to provide one of the sides of the portal.

4. The crusher unit of claim 3, wherein the substructure has sides, wherein the first support means comprises two supporting feet disposed at the sides of the substructure, and wherein there are four supports which are disposed at the corners of a rectangle, each supporting foot being surrounded by a respective two of the supports.

5. The crusher unit of claim 4, wherein the third a support means comprises a transverse carrier disposed between the respective two supports, the transverse carrier being supportable by the respective supporting foot if the substructure is lifted.

6. The crusher unit of claim 1, further comprising another member, means for mounting the another member immovably with respect to the substructure, and means for selectively connecting the housing to the another member.

7. The crusher unit of claim 6, wherein the means for mounting the another member comprises means for joining the another member to at least one of the substructure and the crusher.

8. The crusher unit of claim 6, wherein the crusher has an upper region, wherein the another member is disposed adjacent the upper region of the crusher, and wherein the means for selectively connecting comprises a latch which is positioned to engage the another member.

9. The crusher unit of claim 8, wherein the another member has a vertical bore, and wherein the latch comprises a pin which fits into the bore.

10. The crusher unit of claim 9, wherein the pin has an end that is conically tapered.

11. The crusher unit of claim 6, wherein the third support means comprises at least one latchable seat.

12. The crusher unit of claim 1, further comprising conduits extending from the housing, the conduits being equipped with flexible connections.

13. The crusher unit of claim 12, wherein the conduits are disposed between the housing and the substructure.

14. The crusher unit of claim 1, wherein the mobile crushing system includes at least one endless conveyor unit in addition to the crusher unit, and wherein the crusher unit further comprises supply device means in the housing for operating the crusher unit, and control means in the housing for controlling the entire crushing system.

15. The crusher unit of claim 1, further comprising control devices in the housing for controlling the crusher unit.

16. The crusher unit of claim 1, further comprising means in the housing for supplying power to operate the crusher.

17. The crusher unit of claim 1, further comprising a control cabin on top of the housing, the control cabin being disposed at a height that is greater than the height of the crusher.

18. A crusher unit for use in a mobile crushing system, said crusher unit comprising:

a substructure, the substructure including first support means for supporting the substructure on the ground;

a crusher mounted on the substructure;

a housing;

a frame on which the housing is disposed, the frame including second support means for supporting the entire weight of the housing and frame on the ground when the crusher unit is in operation and for isolating the frame and housing from vibration of the crusher unit; and third support means for supporting the frame on the substructure if the substructure is lifted.

19. The crusher unit of claim 18, wherein the substructure has sides, wherein the first support means of the substructure comprises two supporting feet disposed at the sides of the substructure, and wherein the second support means of the frame comprises four supports which are disposed at the corners of a rectangle, each supporting foot being surrounded by a respective two of the supports.

20. The crusher unit of claim 19, further comprising control devices in the housing for controlling the crusher unit, means in the housing for supplying power to operate the crusher, and a control tower disposed at the top of the housing at a height that is greater than the height of the crusher.

* * * * *